US006618867B2

(12) United States Patent
Hodak

(10) Patent No.: US 6,618,867 B2
(45) Date of Patent: Sep. 16, 2003

(54) DECORATIVE SWIMMING POOL BORDER AND METHOD

(76) Inventor: Jerry Hodak, 155 Zahner School Rd., Zelienople, PA (US) 16063

( * ) Notice: Subject to any disclaimer, the term of this patent is extended or adjusted under 35 U.S.C. 154(b) by 0 days.

(21) Appl. No.: 10/347,906

(22) Filed: Jan. 21, 2003

(65) Prior Publication Data

US 2003/0110556 A1 Jun. 19, 2003

Related U.S. Application Data

(62) Division of application No. 09/711,811, filed on Nov. 13, 2000.
(60) Provisional application No. 60/164,642, filed on Nov. 10, 1999.

(51) Int. Cl.[7] ..... E04H 4/14
(52) U.S. Cl. ..... 4/496
(58) Field of Search ..... 4/496, 506; 52/169.7, 52/716.2

(56) References Cited

U.S. PATENT DOCUMENTS

| | | | | |
|---|---|---|---|---|
| 2,729,093 A | * | 1/1956 | Ridley | 52/102 |
| 3,628,198 A | * | 12/1971 | Katzman | 52/716.2 |
| 5,018,324 A | * | 5/1991 | Lankheet | 52/169.7 |
| 5,491,006 A | | 2/1996 | Johnson et al. | 428/13 |
| 5,508,084 A | | 4/1996 | Reeves et al. | 428/172 |
| 5,563,205 A | | 10/1996 | Mayer et al. | 524/556 |
| 5,836,588 A | | 11/1998 | Gerson | 273/348.4 |
| 5,916,102 A | | 6/1999 | Peyton | 52/385 |
| 5,916,662 A | | 6/1999 | Schmidt | 428/141 |
| 5,928,783 A | | 7/1999 | Phan et al. | 428/355 |
| 5,972,155 A | | 10/1999 | Cooprider et al. | 156/269 |
| 6,015,606 A | | 1/2000 | Abe | 428/214 |
| 6,025,070 A | | 2/2000 | Heederik et al. | 428/343 |
| 6,030,002 A | | 2/2000 | Charley et al. | 283/81 |
| 6,066,394 A | | 5/2000 | Hoff et al. | 428/355 |
| 2001/0000258 A1 | * | 4/2001 | McAlpin et al. | 526/348.2 |

OTHER PUBLICATIONS

Performance Vinyl Collection brochure MD2 1/99 40M AD4746.1 (copy).

Ceramic Tile/Coping System Components "Retrofit Ceramic Tile Holder for Existing Pools"—p. 25 (copy).

Quaker Plastic Ceramic Tile/Coping System, "The elegance of real tile on a vinyl liner pool, at a price that is truly affordable." p. 24 (copy).

* cited by examiner

*Primary Examiner*—Charles E. Phillips
(74) *Attorney, Agent, or Firm*—Webb Ziesenheim Logsdon Orkin & Hanson, P.C.

(57) ABSTRACT

A removable swimming pool border for use with a swimming pool having a sidewall and a pool liner includes a flexible facestock layer made of polymeric material. The facestock layer has design indicia on one side thereof. A pressure sensitive adhesive layer is located on the second side of the facestock opposite the design indicia side for removably attaching the swimming pool border to the pool liner of the swimming pool. A removable liner layer is attached to the surface of the pressure sensitive adhesive layer for protecting the pressure sensitive adhesive layer prior to use. The swimming pool border is adhesively attached to the pool liner by the pressure sensitive adhesive layer when the swimming pool border is in use. The swimming pool border is removably attached to the pool liner along a top inner edge of the swimming pool such that the water level of the swimming pool lies along the height of the swimming pool border when the swimming pool border is in use.

7 Claims, 3 Drawing Sheets

DECORATIVE SWIMMING POOL BORDER AND METHOD

CROSS-REFERENCE TO RELATED APPLICATION

This application is a division claims the benefit of U.S. Utility application Ser. No. 09/711,811, filed Nov. 13, 2000, which corresponds to Provisional Application Ser. No. 60/164,642, filed Nov. 10, 1999, entitled "Decorative Swimming Pool Tile Border and Method".

BACKGROUND OF THE INVENTION

1. Field of the Invention

The present invention relates to swimming pool accessories and, more particularly, to self-adhering swimming pool borders for use with swimming pools and the like.

2. Description of the Prior Art

Residential swimming pools, both above-ground and in-ground, are often lined with a flexible plastic liner made of plasticized polyvinyl chloride, which makes the vessel watertight. These vinyl-lined pools may or may not feature a design printed onto the liner of the pool. The majority of above-ground pool liners are a solid color with no printed designs. Printed border designs help to camouflage dirt and scum that commonly occur at the water line of a pool, and provides an overall aesthetically pleasing appearance to the pool.

Printed liners border are generally printed in a rotogravure process at the time the pool liner is being fabricated. This printing process requires a printing plate, which is expensive to prepare, and expensive drying ovens.

Printed liner borders become discolored due to the ultra violet rays of the sun and chemicals present in the water long before the useful watertight life of the pool liner has expired. Thus, it is quite common for the pool owner to want to replace the border after the pool liner is in place. In addition, pool liners often become punctured or torn and are commonly "patched" with a piece of flexible polyvinyl chloride, like that of the existing pool liner, and adhered with an underwater adhesive such as methyl ethel ketone. These patches are often not a match to the liner color and design of the existing pool liner. They also often turn yellow and discolor over time as the glue or adhesive used to bond the patch to the pool liner ages. These unsightly patches are quite common in pool liners and, although they are functional in preventing water loss at the site, they are aesthetically unpleasing and detract from the overall appearance of the pool. The purpose of these patch kits is more functional in providing a watertight seal than aesthetic appearance. Although they may be able to be removed at a later date, they are more likely intended for permanent installation and may alter the existing pool liner on applying or removing.

One known apparatus for providing a "new" pool liner border for a swimming pool having a vinyl liner is illustrated in FIG. 1. The apparatus shown in FIG. 1 is a tile support device 10 which is configured for attachment to a top edge of an in-ground swimming pool wall (not shown) and overhangs the pool liner. The tile support device 10 has a C-shaped cross section which defines a C-shaped recess. A plurality of tiles 12 is received in the C-shaped recess. The tiles 12 are typically ceramic tiles and are held in a registered relationship by the tile support device 10 without the need for adhesives or mortar.

The tile support device 10 shown in FIG. 1 has several disadvantages. First, it is difficult to remove the tiles 12 from the device 10, making cleaning and maintenance of the tiles 12 cumbersome. In addition, it is difficult and costly to install and requires the purchase of ceramic tiles. The tile can freeze and crack if it is not porcelain tile, and broken pieces of ceramic are a hazard to the pool liner and swimmers in the pool. In many cases the addition of the tile holder and the ceramic tile itself would be similar in cost to the purchase of a new liner and therefore cost prohibitive. In order for the tile holder and ceramic tile to be installed it is suggested that the pool be entirely drained so the installer can work from within the pool. This again adds to the expense and time required.

Outside the pool industry, a removable tile display device is known from U.S. Pat. No. 5,916,102 to Peyton. The removable tile disclosed by this reference includes a decorative tile, a holder for the tile, and a releasable adhesive for removably securing the back surface of the tile to the holder. The holder includes a cavity in which the decorative tile is positioned. Decorative tiles of various designs may be substituted within the holder as desired. The tile and holder combination may be permanently affixed to a wall or other planar surface.

Removable signs, wall decorations, decorative borders, and decals are also generally known for applications outside of the pool industry, such as in home decorations. Such removable signs, wall decorations, decorative borders and decals are applied with various applications including repositionable adhesive products such as repositionable note and paper products, repositionable tape and tape flags, easel sheets, repositionable glue stick and the like, but may also include other non-repositionable industrial, commercial, and medical adhesive products. Known repositionable adhesives include Scotchcal® brand Plus numbers 3650-10 and 3470; Scotchcal® brand numbers 3650, 3680, 7725 and 7755; Controltac® brand Plus numbers 180-10, 181-10 and 160-30; and Controltac® brand number 180-10 films all made by the 3M Company, Inc. St. Paul, Minn. Another repositionable adhesive is "Melinex" film, which refers to MELINEX® brand film, number 475-200, from ICI Americas, Inc., Wilmington, Del. The foregoing repositionable adhesives may be used to apply wall murals and wall decorations. Such wall murals and wall decorations often include licensed characters or logos printed on films for decorating the walls of juvenile rooms. One such product is known as the "Room Decorator Kit" made by the 3M Company, Inc., St. Paul, Minn.

With the foregoing background, the present invention seeks to provide a border specifically for use with a swimming pool and which is inexpensive to produce and easy to install. There is a great variety of decorative and aesthetic patterns and designs that can be utilized with the swimming pool border of the present invention for improving the appearance of a swimming pool. Thus, the present invention can provide a simulated tile border, wall mural or mosaic, or a decorative shape that may be used to improve the appearance of a swimming pool or conceal an existing vinyl patch. The present invention can be placed over an existing pool liner to dramatically update or alter the look of the swimming pool without requiring the loss of water and expense of a new liner and installation solely to change or improve its cosmetic appearance. The swimming pool border of the present invention can provide an overall cosmetic improvement where an unattractive water line exists in a plain, solid color liner or provide a new pattern over an existing vinyl liner where a preprinted border has faded or discolored. The present invention may further include a thermometer for providing a point at which the swimming pool border could start and stop without an overlap in the pre-cut swimming pool border sections.

SUMMARY OF THE INVENTION

One presently preferred embodiment of the invention is a removable swimming pool border for use with a swimming pool having a steel sidewall. The swimming pool border includes a magnetic backing layer for removably attaching the swimming pool border to the sidewall of the swimming pool. The swimming pool border further includes a flexible facestock layer made of polymeric material. The facestock layer has designed indicia on one side thereof. The magnetic backing layer is secured to the facestock on the second side thereof opposite the design indicia side. The swimming pool border is removably attached to the sidewall of the swimming pool by magnetic attraction between the magnetic backing layer and the sidewall when the swimming pool border is in use. The swimming pool border is removably attached to the sidewall of the swimming pool along a top inner edge of the swimming pool such that the water level of the swimming pool lies along the height of the swimming pool border when the swimming pool border is in use.

The facestock may be laminated or adhesively secured to the magnetic backing layer. The swimming pool border may be provided as a continuous strip. Ends of the continuous strip may be connected together by a magnetic thermometer. The thermometer may include a pair of opposed flanges which extend outwardly along a longitudinal axis of the thermometer, with the flanges defining a recess extending from the flanges to an inner surface of the thermometer body for providing clearance for the ends of the continuous strip. A magnetic layer may be adhered to the inner surface of the thermometer for removably attaching the thermometer to the sidewall of the swimming pool by magnetic attraction between the magnetic layer and the sidewall when the thermometer is in use with the continuous strip.

The swimming pool border may be provided as a plurality of individual pool tiles configured for positioning in an end-to-end relationship along the top inner edge of the swimming pool. The magnetic backing layer may be made of finely ground magnetic particles embedded in a polyester film layer. The facestock may be made of acrylic or vinyl, or another similar flexible material.

A further presently preferred embodiment of the present invention is also a removable, adhesively-secured swimming pool border for use with a swimming pool having a sidewall and a pool liner. The swimming pool border includes a flexible facestock layer made of polymeric material. The facestock layer has design indicia on one side thereof. A pressure sensitive adhesive layer is located on the second side of the facestock opposite the design indicia side for removably attaching the swimming pool border to the pool liner of the swimming pool. A removable liner layer is attached to the surface of the pressure sensitive adhesive layer for protecting the pressure sensitive adhesive layer prior to use. The swimming pool border is adhesively attached to the pool liner by the pressure sensitive adhesive layer when the swimming pool border is in use. The swimming pool border is removably attached to the pool liner along a top inner edge of the swimming pool such that the water level of the swimming pool lies along the height of the swimming pool border when the swimming pool border is in use.

The pressure sensitive adhesive layer is preferably an acrylic emulsion plasticizer resistant pressure sensitive adhesive. The swimming pool border may be provided as a continuous strip, with ends thereof connected together by an adhesively secured thermometer. The thermometer may include a pair of opposed flanges which extend outwardly along a longitudinal axis of the thermometer, with the flanges defining a recess extending from the flanges to an inner surface of the thermometer body for providing clearance for the ends of the continuous strip. An adhesive layer may be attached to the inner surface of the thermometer and have an adhesive surface for removably attaching the thermometer to the ends of the continuous strip when the thermometer is in use with the continuous strip.

The present invention is also directed to a method of applying a swimming pool border to a pool liner of a swimming pool, and may include the steps of: providing the swimming pool border as described hereinabove; lowering the water level of the swimming pool to a level below the desired location of the swimming pool border; cleaning and drying the pool liner of the swimming pool at the desired location of the swimming pool border; removing the liner layer from the surface of the pressure sensitive adhesive layer from the swimming pool border; applying the swimming pool border to the pool liner of the swimming pool at the desired location of the swimming pool border, with the pressure sensitive adhesive layer in contact with the pool liner and removably securing the swimming pool border thereto; and returning the water level to a level that lies along the height of the swimming pool border. The method may further include the steps of providing the swimming pool border as a plurality of individual pool tiles; and applying the pool tiles to the pool liner in an end-to-end relationship along a top inner edge of the swimming pool.

Further details and advantages will become apparent from the following detailed description, in conjunction with the drawings wherein like parts are designated with like reference numerals.

DETAILED DESCRIPTION OF THE PREFERRED EMBODIMENTS

Figure 1:
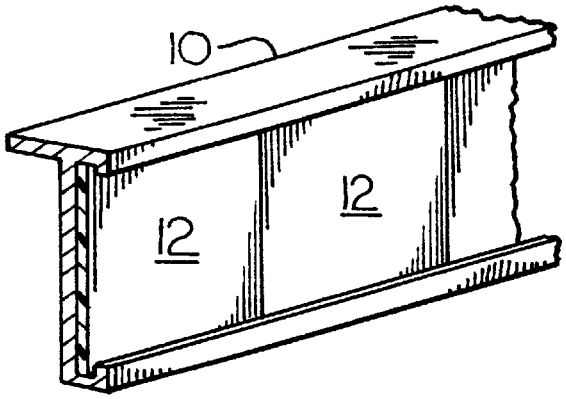
Fig. 1 PRIOR ART
FIG. 1 is a perspective view of a prior art apparatus for supporting swimming pool ceramic tiles.
Figure 2:
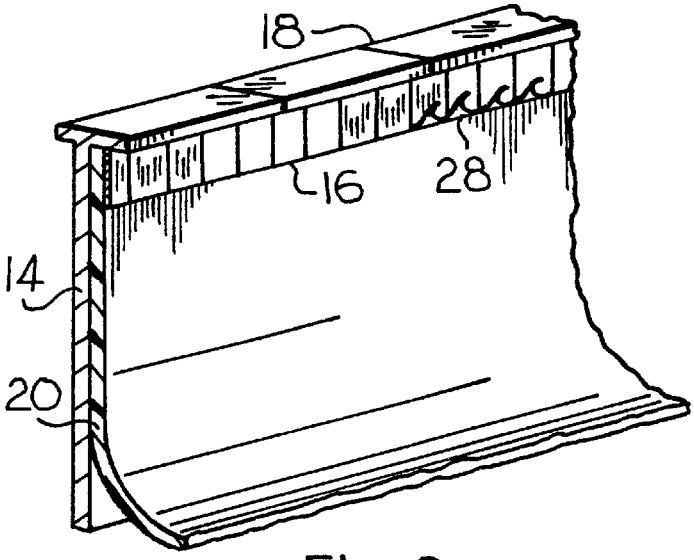
FIG. 2 is a perspective view of a portion of an in-ground or above-ground swimming pool sidewall having a magnetic swimming pool border forming a decorative tile border in accordance with a first embodiment of the present invention.

Referring to FIG. 2, a portion of a sidewall 14 of a swimming pool is shown. A magnetic swimming pool border 16 made in accordance with a first embodiment of the present invention is shown attached to the sidewall 14. The swimming pool (not shown) is generally comprised of a plurality of individual sidewall panels positioned in end-to-end relationship and secured together at terminal end edges. A top rail 18 is secured to the top edge of the sidewall 14 and extends around the perimeter of the swimming pool. A pool liner 20 is attached to the sidewall 14, and preferably to the top rail 18. The swimming pool sidewall 14 just described may be used as part of an in-ground swimming pool or as part of an above-ground swimming pool and is well-known and conventional in the art. At the present time, approximately 70% of the above-ground and in-ground swimming pools built in the United States include sidewall panels that are made of steel. The pool liner 20 attached to the sidewall 14 and the top rail 18 is made of plastic, such as vinyl, and is relatively thin-walled.

Figure 3:
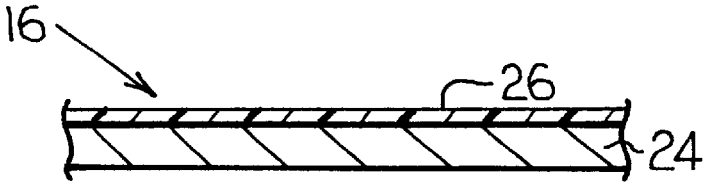
FIG. 3 is a cross-sectional view of the magnetic swimming pool border shown in FIG. 2.
Figure 4:
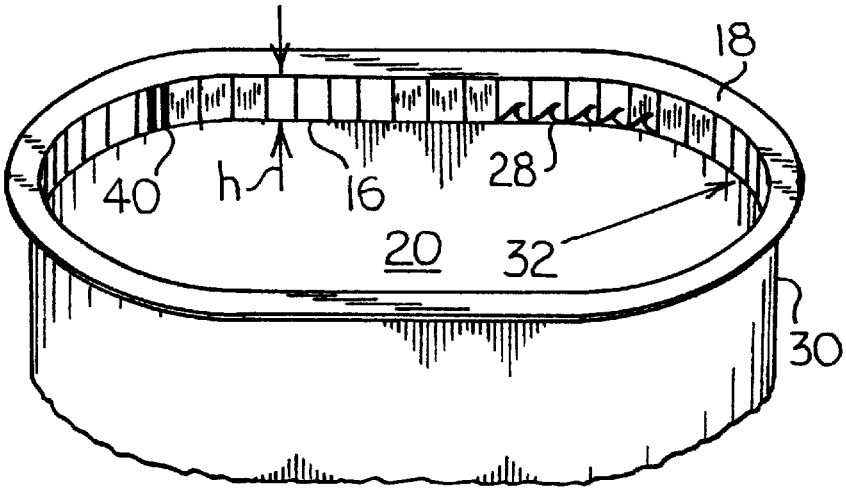
FIG. 4 is a perspective view of a typical steel sidewall, vinyl liner swimming pool having the magnetic swimming pool border of the present invention applied along a top inner edge of the swimming pool.

Referring now to FIGS. 2–4, the magnetic swimming pool border 16 made in accordance with a first embodiment of the present invention will now be discussed in greater detail. The pool border 16, as shown in cross section in FIG. 3, includes a thin magnetic backing layer 24 of between about 25 and 40 mils, which is used to attach the pool border 16 to the sidewall 14. The sidewall 14 is preferably made of steel. The magnetic backing layer 24 is flexible and preferably comprised of finely ground magnetic particles embedded in, or adhered to, a thin polyester film. A suitable material for the magnetic backing layer 24 is manufactured by Master Magnetics, Inc. and sold under the trademark KOROSEAL®.

A decorative facestock layer 26 is applied to the magnetic backing layer 24. The facestock 26 may be ceramic, acrylic or vinyl. The facestock 26 may be applied to the magnetic backing layer 24 by lamination, or by adhesively securing the facestock 26 to the magnetic backing layer 24. The facestock 26 is preferably selected for its aesthetic appearance to add to the overall appearance of the swimming pool, and preferably includes design indicia 28 on the outward facing side thereof. Thus, the facestock 26 may be specifically designed to resemble conventional ceramic tile. The facestock 26 preferably has a thickness of between about 3.5 to 40.00 mils. The decorative side of the facestock 26 may be printed and covered with a light coat of varnish or polyurethane as protection for the decorative indicia thereon. This light coat may be cured by the ultra violet (UV) rays of the sun.

FIG. 4 shows a swimming pool 30 with the pool border 16 aligned along a top inner edge 32 of the swimming pool 30. The swimming pool 30 may include a pool liner 20. The swimming pool border 16 when positioned around the top inner edge 32 of the swimming pool 30 forms a decorative border to enhance the decorative appearance of the swimming pool 30. The swimming pool border 16 is attached by magnetic attraction between the magnetic backing layer 24 and the steel sidewall 14 of the swimming pool 30. Thus, the magnetic backing layer 24 is in contact with the pool liner 20, and is magnetically attracted to the sidewall 14 through the pool liner 20.

The pool border 16 may be provided as individual square or rectangular "tile" units or as a continuous strip which can be cut to the desired pool perimeter length, or to any length desired. In the individual "tile" form, the tiles are placed in end-to-end relationship along the top inner edge 32 of the swimming pool 30. The swimming pool border 16 in accordance with the present invention generally protects the pool liner 20 above the water line from harmful UV rays, and chemical deteriorations which are most commonly found at the water line. Thus, the water line of swimming pool 30 preferably lies along the height of the pool border 16 when in use.

The magnetic pool border 16 made in accordance with the first embodiment of the present invention is used as described hereinafter. The pool border 16 is positioned along the top inner edge 32 of the swimming pool 30, with the magnetic backing layer 24 placed in contact with the pool liner 20. The swimming pool border 16 may be continuous, or in distinct pieces. The magnetic backing layer 24 is magnetically attracted to the steel sidewall 14 which lies under the pool liner 20. The height h of the pool border 16 is preferably sized large enough such that the usual water level in the swimming pool 30 lies somewhere along the height h of the pool border 16. The pool border 16, due to the magnetic backing layer 24, is easily removed for cleaning scum and debris that attaches to the swimming pool border 16 over time.

Figure 5:
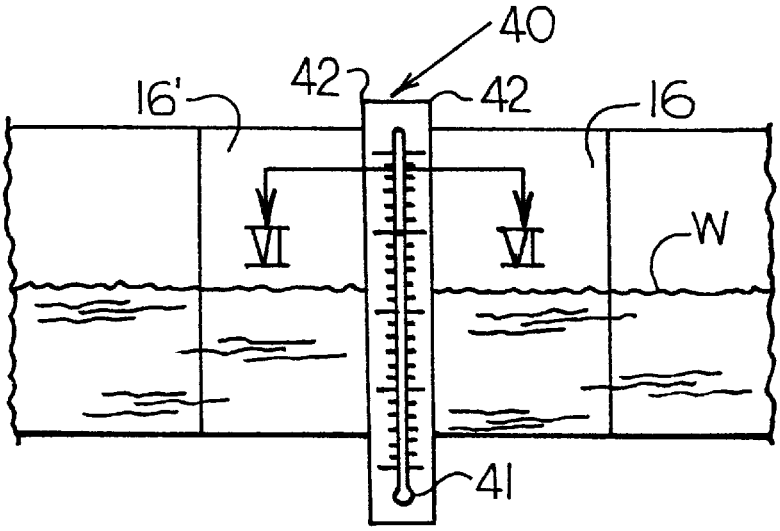
FIG. 5 is a side elevation view of a thermometer in combination with the magnetic swimming pool border according to the first embodiment of the present invention.

The present invention also envisions a decorative thermometer 40 for use with the pool border 16. The thermometer 40 is used to measure the water temperature in the swimming pool 30 and to serve as a starting and termination point for ends of the pool border 16 when supplied as a continuous strip. The thermometer 40 will eliminate a pattern overlap or gap where the two ends of the continuous pool border 16 meet. The thermometer 40 is shown schematically in FIG. 4 and in greater detail in FIGS. 5 and 6. As shown in FIG. 5, the thermometer has a temperature sensing end 41 which is located below the water line "w".

Figure 6:
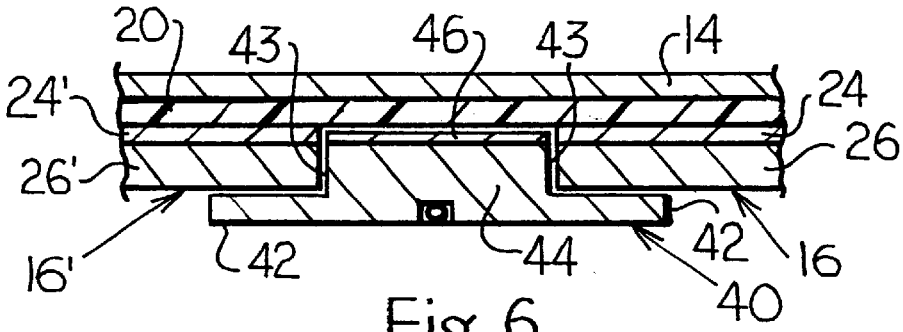
FIG. 6 is an enlarged, cross-sectional view of the thermometer taken along line VI—VI of FIG. 5.

The novel thermometer 40 of the present invention as shown in FIG. 6 preferably has two opposed flanges 42 which extend outwardly along the longitudinal axis of the thermometer. The flanges 42 define a recess or gap 43 extending from the flanges to an inner surface 44 of the thermometer body to provide clearance for the adjacent ends 16, 16' of the pool border 16 to slip underneath. The inner surface 44 of the thermometer 40 has a magnetic or adhesive layer 46 adhered thereto, which is magnetically attracted to the steel sidewall 14 of the swimming pool 30 through the pool liner 20, or adhesively attached to the pool liner 20.

Figure 7:
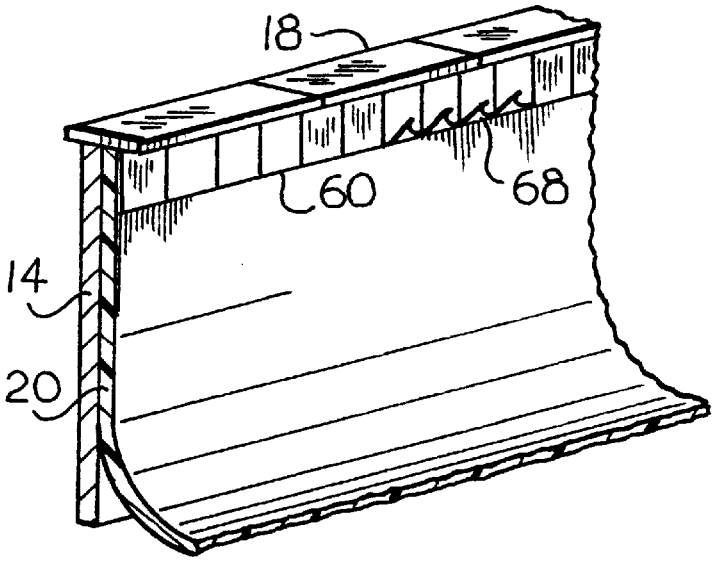
FIG. 7 is a perspective view of a portion of a swimming pool sidewall having an adhesively attached swimming pool border forming a decorative tile border in accordance with a second embodiment of the present invention.
Figure 8:
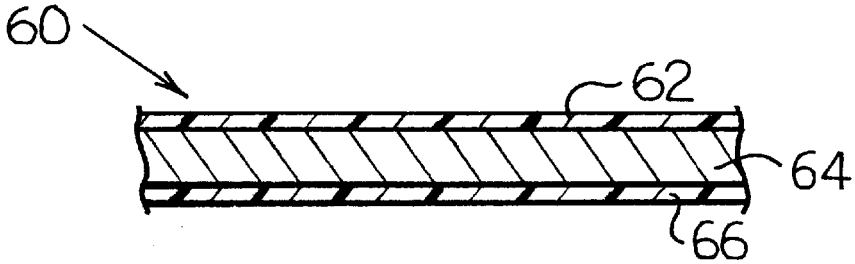
FIG. 8 is a cross-sectional view of the adhesively attached swimming pool border shown in FIG. 7.
Figure 9:
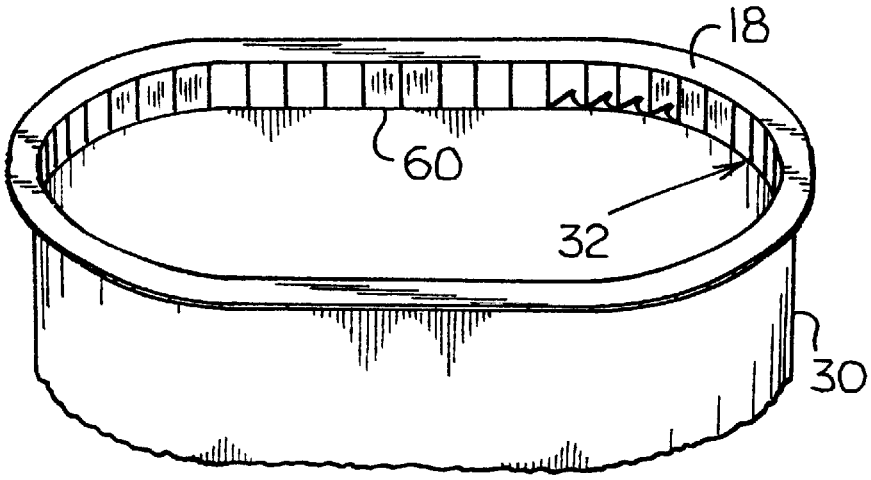
FIG. 9 is a perspective view of a typical in-ground or above-ground swimming pool having the adhesively attached swimming pool border of the present invention applied along the top inner edge of the swimming pool.

Referring to FIGS. 7–9, a swimming pool border 60 in accordance with a second embodiment of the present invention is shown. The pool border 60 is preferably provided as a continuous strip, but may be provided as individual pool "tile" form discussed previously. The pool border 60 includes a flexible facestock layer 62 (hereinafter "facestock 62") of between about 2.0 to 4.0 mils in thickness. The facestock 62 is preferably provided as a thin polymeric plastic film, such as is commonly used in outdoor labeling for its excellent resistance to moisture, chemicals, and temperature extremes, such as vinyl and the like. The facestock 62 is backed with a pressure-sensitive adhesive layer 64, which is preferably resistant to water, detergents, and alcohol. The pool border 60 is preferably adhered directly to the pool liner 20 of the swimming pool 30 with the pressure sensitive adhesive layer 64. Suitable pressure sensitive adhesives will include an emulsion acrylic that is plasticizer resistant such as the adhesives disclosed by U.S. Pat. No. 6,025,070 to Heederik et al.; U.S. Pat. No. 6,066,394 to Hoff et al.; and U.S. Pat. No. 5,563,205 to Mayer et al., incorporated herein by reference. The pressure sensitive adhesive layer 64 is also preferably moisture resistant such as the adhesive disclosed by U.S. Pat. No. 5,928,783 to Phan et al., also incorporated herein by reference.

The surface of pressure sensitive adhesive layer 64 is protected by a removable liner layer 66, which may be a clay coated, bleached or semi-bleached liner. The liner layer 66 is removable from the surface of the pressure sensitive adhesive layer 64 for attaching the pool border 60 to the pool liner 20. The facestock 62 is preferably printed with design indicia 68 by using, for example, a silk-screening method. The printing process preferably utilizes UV ink for resistance to the UV rays of the sun and chemicals present in the pool water.

The printing process of the facestock 62 is also preferably a mirror-image printing process. As such, the design printed on the facestock 62 is created by printing one side of the facestock 62, i.e., the design indicia side, yet the pool border 60 gives the visual impression that the design has been printed on both sides of the facestock 62. Once the facestock 62 is printed, the pressure sensitive adhesive layer 64 may be applied to the other side of the facestock 62, i.e., the side opposite the design indicia side. The protective liner layer 66 is then applied to the pressure sensitive adhesive layer 64 to protect this layer prior to installing the pool border 60.

Referring now to FIGS. 7–9, installation of the pool border 60 will now be discussed in greater detail. As shown in FIG. 9, the pool border 60 is applied to the top inner surface 44 of the swimming pool 30. The pool border 60 can be cut into desired shapes and sizes prior to application to the swimming pool, or applied as a continuous piece around the perimeter of the swimming pool 30. In this configuration, the previously discussed novel thermometer 40 may be used to connect the ends of the pool border 60, or hide the seam present at this connection point. For example, the pool border 60 may include a plurality of individual sections each having a width of about six inches and a length of about twenty-four inches for ease of positioning along the top inner edge of the swimming pool. Alternatively, the pool border 60 may be provided as individual squares or rectangles, for positioning in end-to-end relationship along the top inner surface 44 of the swimming pool 30. A suitable size for the "squares" could be six inch by six inch squares, as an example. The pool border 60 may also be sized to cover an existing pool patch, and could even be provided in various shapes and configurations to decorate the swimming pool 30.

Generally, the pool border 60 is applied to the top inner edge 32 of the swimming pool 30 adjacent a top rail extending around the perimeter of the swimming pool 30. In a preferred method of installation, the swimming pool 30 is drained of pool water to a point one to three inches below the intended bottom edge of the pool border 60. The pool liner 20 along the top inner edge 32 of the swimming pool 30 is then cleaned and allowed to dry. The liner layer 66 is then removed from the pressure sensitive adhesive layer 64. The pool border 60 is then attached to the pool liner 20 along the top inner edge 32 of the swimming pool 30 with the pressure sensitive adhesive layer 64. Because the pressure sensitive adhesive layer 64 is removable, the pool border 60 may be repositioned as necessary to facilitate its installation along the top inner edge 32 of the swimming pool 30 and, further, is easily replaceable with another pool border 60 having a different design when a new look is desired. As discussed previously, the pool border 60 may be a continuous strip, and because of its thin, flexible nature may be provided in a roll format which allows the user to easily cut the pool border 60 to desired lengths as necessary for installation. The pool border 60 according to the second embodiment of the present invention is not limited to steel-walled pools as are the magnetic pool borders 16 discussed previously.

In view of the foregoing, the present invention provides a swimming pool border that may be used with both above-ground and in-ground swimming pools, and which is removable and simple to install. The swimming pool border of the present invention is easily removable for cleaning or replacement. In addition, the swimming pool border, in accordance with the present invention, is relatively inexpensive to produce and install relative to conventional ceramic tile pool borders. Obvious modifications and alterations of the present invention may be made without departing from the spirit and scope of the invention. The present invention is defined by the appended claims and equivalents thereto.

I claim:

1. A decorative border for installation on a sidewall of a swimming pool, comprising:

a continuous strip having a facestock layer on one side of the continuous strip having design indicia thereon; and a backing layer on a reverse side of the continuous strip opposite the facestock layer and including means for removably attaching the continuous strip to the swimming pool sidewall along a water level line thereof, wherein ends of the continuous strip are connected together by an adhesively secured thermometer when the continuous strip is attached to the swimming pool sidewall, and wherein the thermometer further comprises:

a pair of opposed flanges which extend outwardly along a longitudinal axis of the thermometer, with the flanges defining a recess extending from the flanges to an inner surface of the thermometer body for providing clearance for the ends of the continuous strip; and an adhesive layer attached to the inner surface of the thermometer and having an adhesive surface for removably attaching the thermometer to the ends of the continuous strip when the thermometer is in use with the continuous strip.

2. The swimming pool border of claim 1, wherein the attaching means of the backing layer is a pressure sensitive adhesive layer.

3. A method of appying a swimming pool border to a pool liner of a swimming pool, comprising the steps of:

providing the swimming pool border comprising:

a flexible and pliable facestock layer made of polymeric material, with the facestock having design indicia on one side thereof;

a pressure sensitive adhesive layer on the second side of the facestock for removably attaching the swimming pool border to the pool liner of the swimming pool; and a removable liner layer attached to the surface of the pressure sensitive adhesive layer for protecting the pressure sensitive adhesive layer prior to use;

lowering the water level of the swimming pool to a level below the desired location of the swimming pool border;

cleaning and drying the pool liner of the swimming pool at the desired location of the swimming pool border;

removing the liner layer from the surface of the pressure sensitive adhesive layer;

applying the swimming pool border directly to the pool liner of the swimming pool at the desired location of the swimming pool border, with the pressure sensitive adhesive layer in contact with the pool liner and removably securing the swimming pool border thereto; and returning the water level to a level that lies along the height of the swimming pool border;

further comprising the steps of providing the swimming pool border as a continuous pliable strip, and applying the continuous strip to the pool liner along a top inner edge of the swimming pool;

further comprising the step of joining ends of the continuous strip with a thermometer.

4. The method of claim 3, the thermometer comprising a pair of opposed flanges extending outward along a longitudinal axis of the thermometer, the flanges defining a recess extending from the flanges to an inner surface of the thermometer body providing clearance for the ends of the continuous strip, the method comprising receiving the ends of the continuous strip in the recess and securing the ends of the continuous strip to the inner surface with an adhesive.

5. The method of claim 3 further comprising the steps of providing the swimming pool border as a plurality of individual pool tiles, and applying the pool tiles to the pool liner in end-to-end relationship along a top inner edge of the swimming pool.

6. The method of claim 3, further comprising the steps of providing the swimming pool border as a continuous pliable strip, and trimming the continuous strip to predetermined lengths for application to the swimming pool liner.

7. The method of claim 6, wherein the continuous pliable strip is provided in roll form, and the method further comprises unrolling the continuous strip prior to the trimming step.

* * * * *